US009862529B2

(12) United States Patent
Ujiie

(10) Patent No.: US 9,862,529 B2
(45) Date of Patent: Jan. 9, 2018

(54) LID BODY FOR WET WIPES PACKAGE AND WET WIPES PACKAGE

(71) Applicant: DAIO PAPER CORPORATION, Shikokuchuo-shi, Ehime (JP)

(72) Inventor: Kodai Ujiie, Shikokuchuo (JP)

(73) Assignee: DAIO PAPER CORPORATION, Shikokuchuo-shi, Ehime (JP)

( * ) Notice: Subject to any disclaimer, the term of this patent is extended or adjusted under 35 U.S.C. 154(b) by 66 days.

(21) Appl. No.: 14/901,665

(22) PCT Filed: Jul. 1, 2014

(86) PCT No.: PCT/JP2014/067530
§ 371 (c)(1),
(2) Date: Dec. 28, 2015

(87) PCT Pub. No.: WO2015/002189
PCT Pub. Date: Jan. 8, 2015

(65) Prior Publication Data

US 2016/0159534 A1 Jun. 9, 2016

(30) Foreign Application Priority Data

Jul. 1, 2013 (JP) ..... 2013-137892

(51) Int. Cl.
*B65D 83/08* (2006.01)
*B65D 51/18* (2006.01)
(Continued)

(52) U.S. Cl.
CPC ..... *B65D 51/18* (2013.01); *A47K 10/421* (2013.01); *B65D 75/5877* (2013.01);
(Continued)

(58) Field of Classification Search
CPC ..... A47K 10/421; A47K 2010/3266; B65D 51/18; B65D 51/20; B65D 43/22;
(Continued)

(56) References Cited

U.S. PATENT DOCUMENTS 6,604,628 B1 * 8/2003 Tanaka ..... A47K 10/421 206/207
2003/0159403 A1 8/2003 Verespej et al.
(Continued)

FOREIGN PATENT DOCUMENTS

JP 3057278 U 4/1999
JP 2001225880 A 8/2001
(Continued)

OTHER PUBLICATIONS

International Preliminary Report on Patentability (IPRP) including Written Opinion (and English translation thereof) dated Jan. 5, 2016, issued in parent International Application No. PCT/JP2014/067530.
(Continued)

*Primary Examiner* — Anthony Stashick
*Assistant Examiner* — Mollie Impink
(74) *Attorney, Agent, or Firm* — Holtz, Holtz & Volek PC

(57) ABSTRACT

A lid body for a wet wipes package includes a frame and a lid. The frame has a frame opening surrounding a body opening. The lid is pivotally coupled to the frame via a hinge section to cover the frame opening from the front surface. The frame has a mating member peripherally disposed thereon and protruding from the surface. The mating member includes an internal wall, an external wall and a groove defined therebetween. The lid has the projection peripherally disposed thereon and protruding from the rear surface of the lid to be fitted into the groove. A distance between the projection and the hinge section at a position with the
(Continued)

shortest distance between the frame opening and the hinge section is at least five times an overlapping height between the projection and the mating member.

5 Claims, 3 Drawing Sheets

(51) Int. Cl.
*B65D 75/58* (2006.01)
*A47K 10/42* (2006.01)
*A47K 10/32* (2006.01)

(52) U.S. Cl.
CPC ..... *B65D 75/5894* (2013.01); *B65D 83/0805* (2013.01); *A47K 2010/3266* (2013.01); *B65D 2251/0021* (2013.01); *B65D 2251/0093* (2013.01); *B65D 2575/586* (2013.01)

(58) Field of Classification Search
CPC ..... B65D 75/5833; B65D 75/5894; B65D 83/0805; B65D 75/5877; B65D 75/5838; B65D 2575/586
USPC ..... 206/494; 220/254.3, 254.7
See application file for complete search history.

(56) References Cited

U.S. PATENT DOCUMENTS

| | | | | |
|---|---|---|---|---|
| 2005/0211718 | A1* | 9/2005 | Decker | A47K 10/421 221/63 |
| 2006/0151518 | A1 | 7/2006 | Sarbo et al. | |
| 2007/0246477 | A1 | 10/2007 | Decker et al. | |
| 2007/0295744 | A1 | 12/2007 | Sarbo et al. | |
| 2014/0001196 | A1* | 1/2014 | Bushman | B65D 75/5833 221/45 |
| 2016/0052681 | A1* | 2/2016 | Hendricks | B65D 43/0212 220/254.3 |

FOREIGN PATENT DOCUMENTS

| | | | |
|---|---|---|---|
| JP | 2006062690 | A | 3/2006 |
| JP | 2011025980 | A | 2/2011 |
| JP | 2012012034 | A | 1/2012 |

OTHER PUBLICATIONS

Extended European Search Report (EESR) dated Jan. 23, 2017, issued in counterpart International Application No. PCT/JP2014/067530.
International Search Report (ISR) dated Aug. 26, 2014 issued in International Application No. PCT/JP2014/067530.

* cited by examiner

LID BODY FOR WET WIPES PACKAGE AND WET WIPES PACKAGE

TECHNICAL FIELD

The present invention relates to a lid body wet wipes package to be attached to the bag body of a wet wipes package and the wet wipes package provided with the lid body.

BACKGROUND ART

Bags are known that contain wet wipes saturated with water, alcohol, and/or liquid medical agents. Such a bag is generally provided with a re-adherable lid or flap like a film label; the flap adheres to an area surrounding an opening for taking the wet wipes out of the bag to block the opening when they are not in use.

Unfortunately, repeated opening and closing of the flap on a conventional bag reduces its adhesive force due to attachment of the liquid or dust, which causes the flap to peel off by itself. Such low adhesion of the flap also reduces the sealability and thus airtightness of the bag.

To secure the airtightness of the bag, a lid body that includes an annular frame and a lid (openable lid) is disclosed, in, for example, Patent Document 1. More specifically, the annular frame has an opening surrounding the film label-like flap and the lid is coupled to the frame in a freely openable and closable manner so as to block the opening from the front of the frame. The lid body is bonded to the top surface of the bag with adhesive applied to the rear of the frame.

In particular, the frame in Patent Document 1 is provided with a flange (projection) protruding from the top surface around the opening and the lid is provided with a recess (depressed portion) on the rear surface thereof, the recess being engaged with the projection, to secure the airtightness of the bag and block the air or dust from the outside.

To reduce interference between the projection and the recess as much as possible, the recess is defined by an inner vertical wall and an outer vertical wall, each having a substantially C shape in the plan view, and the inner vertical wall and the outer vertical wall are disposed such that the open parts of the substantially C-shaped inner vertical wall and the outer vertical wall do not overlap with each other and face each other.

PRIOR ART DOCUMENT

Patent Document

Patent Document 1: Japanese Patent Laid-open Publication No. 2011-25980

SUMMARY OF INVENTION

Problems to be Solved by the Invention

Unfortunately, the technique disclosed in Patent Document 1 cannot adequately secure the airtightness of the bag because air is likely to leak from the open parts of the inner vertical wall and the outer vertical wall.

An object of the present invention is to provide a wet wipes package and a lid body for the wet wipes package that ensure a smooth opening and closing of the lid, while securing the airtightness of the bag.

Means for Solving the Problem

To achieve the above described object, according to a first aspect of the present invention, there is provided a lid body for a wet wipes package to be attached to a bag body of the wet wipes package, comprising:

a frame having a frame opening surrounding a bag opening formed on a top surface of the bag body; and a lid pivotally coupled to one end of the frame via a hinge section and blocking the frame opening from a front of the frame; wherein one of the frame and the lid has a projection peripherally disposed thereon and protruding from a rear of the lid or the front of the frame, another of the frame and the lid has a mating member peripherally disposed thereon and protruding from the rear of the lid or the front of the frame, the mating member being engageable with the projection, the mating member includes an internal wall, an external wall, and a groove defined therebetween, and a distance between the projection and the hinge section at a position with the shortest distance between the frame opening and the hinge section is at least five times an overlapping height between the projection and the mating member.

According to a second aspect of the invention, in the lid body according to the first aspect of the invention, the internal wall has an upper end bent inward to define a guide which guides the projection to be fitted into the groove, and the external wall is notched near each longitudinal center of the two widthwise ends thereof on the frame or the lid.

According to a third aspect of the invention, the lid body according to the first or second aspect of the invention further includes:

a tab disposed on a widthwise end of the lid, the widthwise end not being connected to the hinge section;

a locking part disposed on a widthwise end of the frame, the widthwise end not being connected to the hinge section, the locking part being engageable with the tab; and push tabs disposed on the widthwise end of the frame, the widthwise end not being connected to the hinge section, the push tabs each being disposed on each side of the locking part.

According to a fourth aspect of the invention, in the lid body according to any one of the first to third aspects of the invention, an area surrounded by the projection or the mating member peripherally disposed on the lid has higher rigidity in the widthwise direction of the lid than the outside of the area surrounded by the projection or the mating member of the lid.

According to a fifth aspect of the invention, there is provided a wet wipes package including:

a bag that includes a bag body having a body opening on a top surface thereof and a flap covering the body opening in a freely openable and closable manner; and the lid body for the wet wipes package according to any one of the first to fourth aspects of the invention, the lid body being attached to the top surface of the bag body.

Effects of Invention

The present invention provides the projection to be fitted into the groove to block the opening of the bag, thus securing the airtightness of the bag. The present invention can provide an adequate distance between the projection and the hinge section to reduce interference between the lid and the internal wall and between the lid and the external wall at the time of opening and closing the lid. This configuration can ensure a smooth opening and closing of the lid, while securing the airtightness of the bag.

DESCRIPTION OF PREFERRED EMBODIMENTS

With reference to the drawings, an embodiment of the present invention will now be described.

Figure 1:
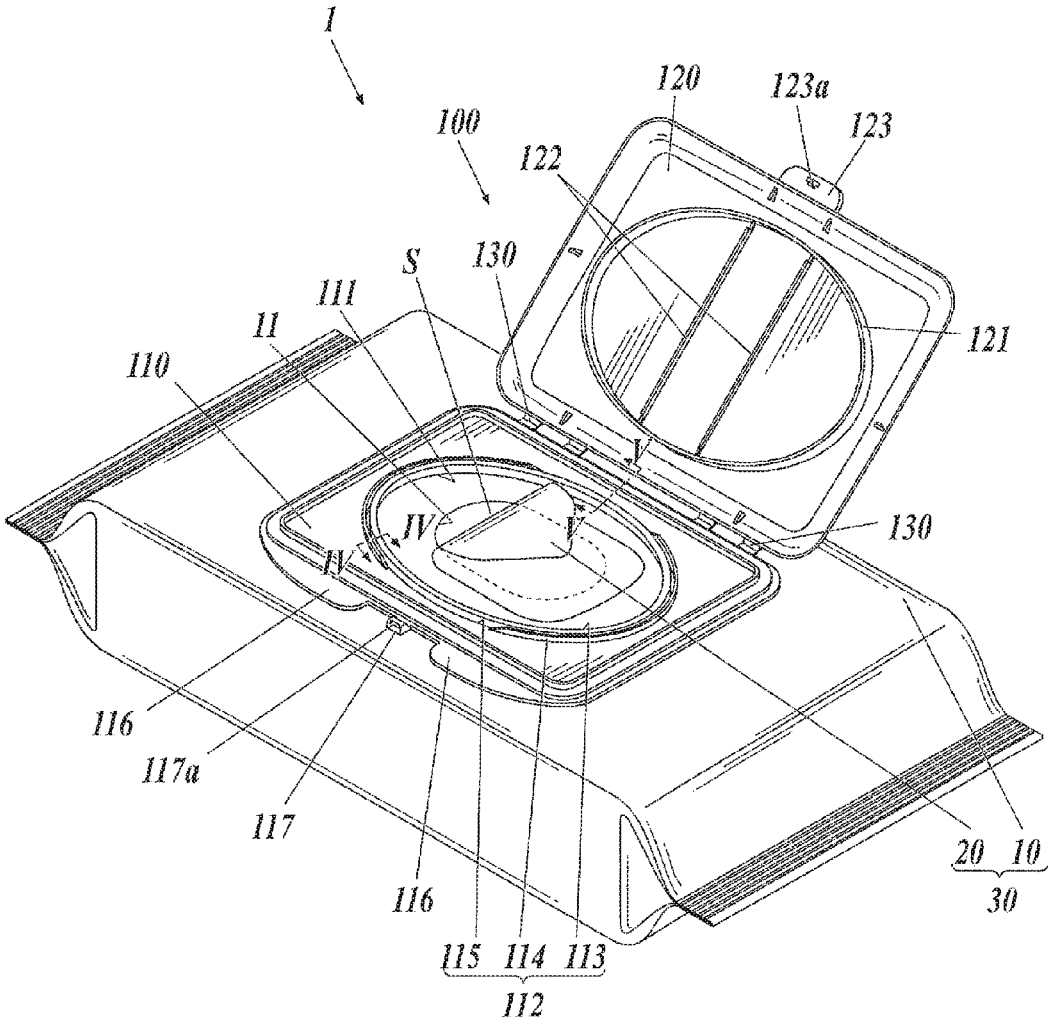
FIG. 1 is a perspective view of an exemplary lid body for a wet wipes package when the lid is opened on the package.
Figure 2:
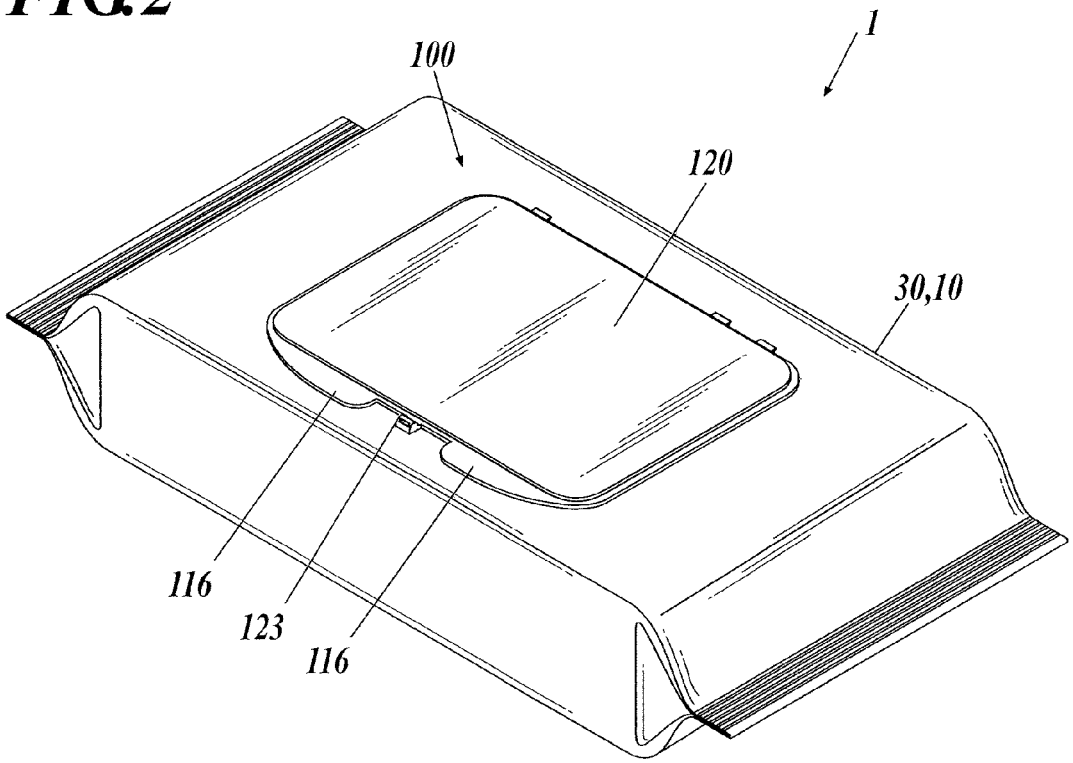
FIG. 2 is a perspective view of the exemplary lid body for the wet wipes package when the lid is closed on the package.
Figure 3:
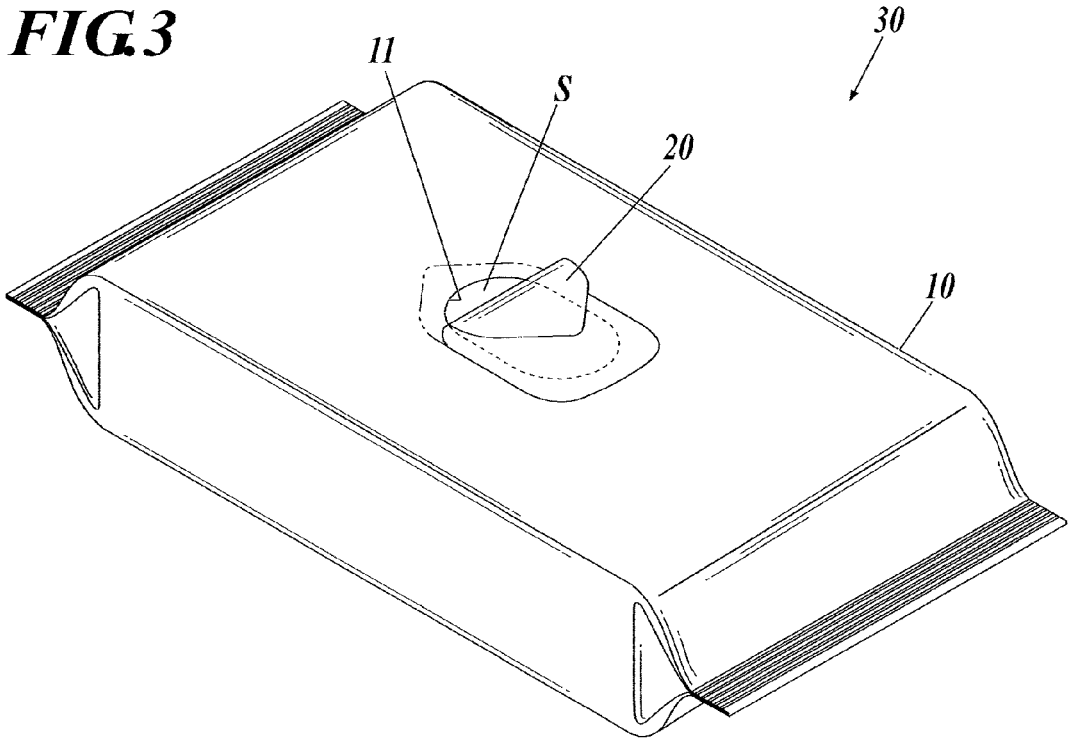
FIG. 3 is a perspective view of the bag.

As shown in FIGS. 1 to 3, a wet wipes package 1 according to this embodiment includes a bag 30 and a lid body 100 for a wet wipes package (hereinafter merely lid body 100). The bag 30 includes a bag body 10 having a body opening 11 and a flap 20, like a film label, that covers the body opening 11 in a freely openable and closable manner. The lid body 100 is mounted on the top surface of the bag body 10.

The configuration of the bag 30 will now be described.

The bag 30 contains wet wipes S stacked in the bag body 10 and has the body opening 11 for taking them out of the bag one by one.

In the following description, a surface with the body opening 11 of the bag 30 is referred to as a top surface and the opposite surface as bottom surface.

The bag body 10 is a bag made of a sheet material. For example, the sheet material may be a monolayer or multilayer sheet composed of a single or multiple synthetic resins, such as polyethylene, polypropylene, poly(ethylene terephthalate) polyesters, polyamides, or poly(vinyl chloride), or of a composite sheet of a synthetic resin sheet with aluminum foil or paper applied thereto, for example.

The sheet material of the bag body 10 is jointed on the bottom side (not shown) of the bag body 10 along its longitudinal direction and on opposing surfaces at the two ends in the longitudinal direction of the bag body 10.

The body opening 11 formed on the top surface of the bag body 10 may have any shape such as oval, as shown in FIG. 3, circular, rectangular, or rounded rectangular.

The flap 20 is a sheet separate from the bag body 10 that covers the body opening 11 in a freely openable and closable manner. Like the bag body 10, the flap 20 is composed of a single or multiple synthetic resins, such as polyethylene, polypropylene, poly(ethylene terephthalate), polyester, polyamide, or poly(vinyl chloride) or of a composite sheet of a synthetic resin sheet with aluminum foil or paper applied thereto, for example. The flap 20 may have any shape that can completely cover the body opening 11 such as a rectangular or oval shape.

The back side of the flap 20 is coated with a polyester, acrylic or rubber pressure sensitive adhesive, and the flap 20 adheres to the bag body 10 such that the flap 20 covers the body opening 11 in a freely openable and closable manner.

The wet wipes S are stacked in the bag 30. A stack of approximately 10 to 150 wet wipes S are preferred. The wet wipes S are nonwoven fabrics made from predetermined fibers produced by a known technique, such as spun lace, air through, air laid, point bonding, spun bonding, or needle punching. The predetermined fibers include, for example, cellulosic fibers (such as rayon, lyocell, tencel, and cotton), polyolefin fibers (such as polyethylene, polypropylene and poly(vinyl alcohol)), polyester fibers (such as poly(ethylene terephthalate) and poly(butylene terephthalate)), and polyamide fibers (such as nylon). These fibers may be used alone or in combination.

The wet wipes S may be made of paper.

A configuration of the lid body 100 will now be described.

The lid body 100 is composed of, for example, a thermoplastic resin, such as polyethylene (PE), polypropylene (PP), poly(ethylene terephthalate) (PET), or polyamide (PA).

With reference to FIGS. 1 and 2, the lid body 100 blocks the body opening 11 of the bag body 10 and includes a frame 110, a lid 120, and a hinge section 130, which are integrated. The frame 110 has a frame opening 111 that surrounds the body opening 11 and the flap 20. The lid 120 is coupled to the frame 110 in a freely openable and closable manner and blocks the frame opening 111 from the front of the frame 110. The hinge section 130 pivotally couples the lid 120 to the frame 110. The lid 120 has a thickness of approximately 0.5 mm to 2.0 mm, preferably 1.0 mm or less, to reduce the amount of resin used and provide a soft texture in use.

The frame 110 has a rectangular shape having a long side in the longitudinal direction of the bag body 10 and has one of the two widthwise ends (longitudinal edges) coupled to the lid 120 via the hinge section 130. The frame 110 is fixed to the bag body 10 with an adhesive applied to the rear surface thereof.

The frame 110 is provided with a mating member 112 protruding from the surface along the frame opening 111.

Figure 4:
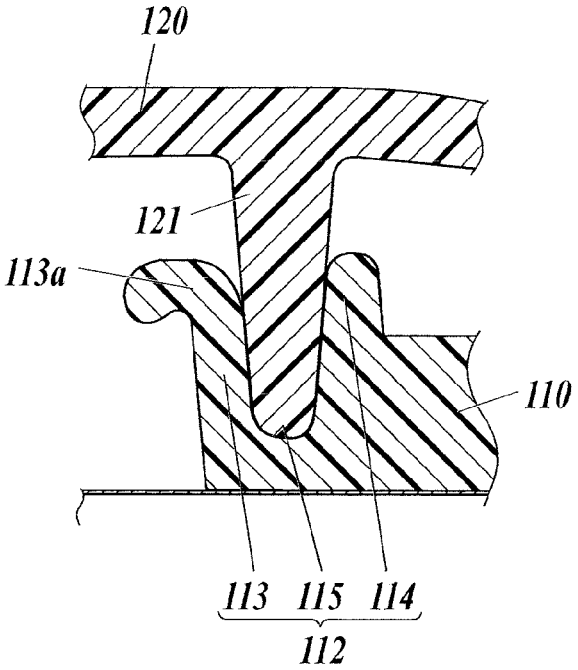
FIG. 4 is an exemplary cross-sectional view taken through line IV-IV of FIG. 1.
Figure 5:
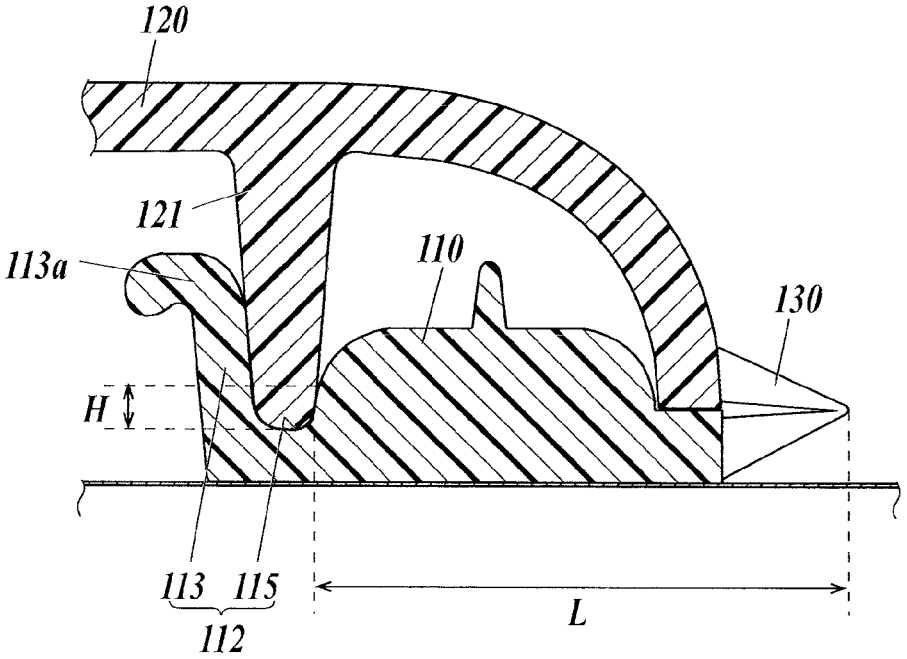
FIG. 5 is an exemplary cross-sectional view taken therough line V-V of FIG. 1.

As shown in FIGS. 2, 4, and 5, the mating member 112 includes an internal wall 113, an external wall 114, and a groove 115 defined therebetween. The internal wall 113 and the external wall 114 have a substantially oval shape in the plan view. The groove 115 is engaged with the projection 121 disposed on the lid 120 (See FIGS. 4 and 5). FIGS. 4 and 5 each illustrate a cross-sectional view of the closed lid 120, i.e., the projection 121 fitted into the groove 115.

The projection 121 has a height of at least 3 mm or m preferably 5 mm or more, and is formed so as to overlap with the internal wall 113 and the external wall 114 of the mating member 112 along the entire circumference of the frame opening 111 when the projection 121 is fitted or the lid body 100 is closed. An overlapping height H between the projection 121 and the mating member 112 is at least 1.5 mm or more, preferably 3 mm or more, to maintain high airtightness. While the projection 121 is fitted into the mating member 112, at the overlapped portion of the projection 121 and the mating member 112, the projection 121 is in close contact with the mating member 112 at least at its tip and in contact with a clearance of 0.2 mm or less at portions other than the tip.

The distance L between the projection 121 and the hinge section 130 at a position with the shortest distance between the frame opening 111 and the hinge section 130 is at least five times, preferably at least ten times the overlapping height H between the projection 121 and the mating member 112. Such an adequate distance between the projection 121 and the hinge section 130 can reduce interference between the projection 121 and the external wall 113 at the time of opening and closing the lid 120.

In the illustrated example, the frame opening 111 is formed in the center of the widthwise direction of the frame 110. Alternatively, the frame opening 111 may be provided away from the hinge section 130 in the widthwise direction, which is preferred because a limited space of the lid body 100 can be utilized effectively. Alternatively, as shown in FIG. 1, the hinge section 130 may be provided so as to protrude outward from the outer periphery of the lid body 100. This is also a preferred configuration to expand the distance L.

The internal wall 113 has an upper end bent inward to define a guide 113*a*. The guide 113*a* allows the projection 121 to be guided into the groove 115 without interference with the internal wall 113.

The external wall 114 is notched near each longitudinal center of the two (both) widthwise ends (two longitudinal edges) of the frame 110.

The frame 110 is provided with a locking part 117 that locks a tab 123 disposed on the lid 120 in the longitudinal center of the other widthwise end (longitudinal edge) remote from the hinge section 130 (the end not connected to the hinge section 130). The locking part 117 has a protrusion 117*a* protruding outward.

The widthwise end (longitudinal edge), not connected with the hinge section, of the frame 110 is provided with the push tabs 116, 116 which each are disposed on each side of the locking part 117.

The push tabs 116 have the shape of a plane plate horizontally protruding from the frame 110. Alternatively, the push tabs 116 may have any shape that allows a user to press them down with a finger(s).

The lid 120 according to this embodiment is preferably thin as described above, but it may pose the following problem: When a user who intends to open the lid body 100 presses down the lid 120 at its center (the area surrounded by the projection 121) with a finger (for example, the middle finger of the left hand) and pushes up the tab 123 of the lid 120 with another finger (for example, the thumb of the left hand), the center of the lid 120 deforms downward. Such deformation causes the tips of the projection 121 near the two widthwise ends (two longitudinal edges) to deform outward and interfere with the external wall 114, thus blocking the opening of the lid 120. However, the push tabs 116, 116 shown in this embodiment makes the center of the lid 120 less likely to be pressed down, which can avoid the interference between the projection 121 and the external wall 114.

The lid 120 has the projection 121 disposed at a position corresponding to the groove 115 of the frame 110. The projection 121 protrudes from the rear face of the lid 120 to be fitted into the groove 115.

Two ribs (reinforcing members) 122, 122 are provided inside the area surrounded by the projection 121 in the widthwise direction of the lid 120. This configuration imparts higher rigidity to the area surrounded by the projection 121 of the lid 120 than the outside of the surrounded area. The number of the ribs 122 is not limited to two; any number of ribs, one or three or more, may be used. Alternatively, the area surrounded by the projection 121 of the lid 120 may be thicker than the outside of the surrounded area by approximately 10% to 100%, but providing the ribs 122 is more preferred because it uses less resin.

When a user who intends to open the lid body 100 presses down the center of the lid 120 (the area surrounded by the projection 121) with a finger (for example, the middle finger of the left hand), the area surrounded by the projection 121 of the lid 120 having higher rigidity than the outside of the surrounded area precludes the downward deformation of the center of the lid 120 and thus alleviate the interference between the projection 121 and the external wall 114.

The widthwise end (longitudinal edge), remote from the hinge section, of the lid 120 (the edge not connected to the hinge section 130), is provided with the tab 123 which is engaged with the locking part 117 disposed on the frame 110. More specifically, the tab 123 is provided with a locking member 123*a* protruding from the rear surface of the tab 123 and to be engaged with the protrusion 117*a* disposed on the locking part 117.

The operation for use of the wet wipes package 1 provided with the lid body 100 according to this embodiment will now be described.

A user performs the following operations on the lid body 100 with the lid closed 120, as shown in FIG. 2: While pressing down the push tab 116 of the frame 110 with a finger (for example, the middle finger of the left hand), the user pushes up the tab 123 of the lid 120 with another finger (for example, the thumb of the left hand). This operation causes the protrusion 117*a* disposed on the locking part 117 of the frame 110 to be disengaged from the locking member 123*a* disposed on the tab 123 and opens the lid 120. The projection 121 of the lid 120, which was engaged with the groove 115 of the mating member 112 of the frame 110, moves upward such that it draws an arc outward. As described above, an adequate distance between the projection 121 and the hinge section 130 can reduce interference between the projection 121 and the external wall 114. The external wall 114, which is notched near the center of the two widthwise ends (two longitudinal edges) of the frame 110, can further reduce the interference between the projection 121 and the external wall 114. The guide 113*a* of the internal wall 113 guides the projection 121 to be fitted into the groove 115, reducing the interference between the projection 121 and the internal wall 113.

The user then peels off the flap 20 that covers the body opening 11 of the bag body 10 to expose the body opening 11 (see FIG. 1). Since the lid 120 functions as a lid of the body opening 11 in this embodiment, the flap 20 is not an essential component and may be designed to be disposed after being peeled off in advance.

The user takes out one of the wet wipes S stacked in the bag 30 through the body opening 11 by holding and pulling it up and then wipes the hands or face with the wet wipe.

After using it, the user re-bonds the flap 20 so as to cover the body opening 11 and closes the lid 120 to reseal the bag 30. If the flap 20 is designed to be disposed, the user only closes the lid 120. The projection 121 is fitted into the groove 115 and the protrusion 117a engages with the locking member 123*a*. An adequate distance between the projection 121 and the hinge section 130 at the time of fitting of the projection 121 into the groove 115 can reduce the interference between the projection 121 and the external wall 114. The external wall 114, which is notched near each center of the two widthwise ends (two longitudinal edges), can further reduce the interference between the projection 121 and the external wall 114. The guide 113*a* of the internal wall 113 can also reduce the interference between the projection 121 and the internal wall 113.

As described above, the lid body 100 according to this embodiment includes the frame 110 and the lid 120. The frame 110 has the frame opening 111, which surrounds the body opening 11 formed on the top surface of the bag body 10. The lid 120 is pivotally coupled to one end of the frame 110 via the hinge section 130 and blocks the frame opening 111 from the front of the frame 110. The frame 110 has the mating member 112 disposed thereon along the frame opening 111 and protruding from the surface of the frame 110. The mating member 112 includes the internal wall 113, the external wall 114, and the groove 115 defined therebetween. The lid 120 has the projection 121 peripherally disposed thereon and protruding from the rear surface thereof to be fitted into the groove 115 of the mating member 112.

In the lid body 100 according to the present embodiment, the projection 121 fitted into the groove 115 can block the body opening 11 of the bag 30 to secure the airtightness of the bag 30.

In the lid body 100 according to the present embodiment, the distance L between the projection 121 and the hinge section 130 at a position with the shortest distance between the frame opening 111 and the hinge section 130 is at least five times the overlapping height H between the projection 121 and the mating member 112. This secures an adequate distance between the projection 121 and the hinge section 130, which can reduce the interference between the projection 121 and the internal wall 113 and between the projection 121 and the external wall 114 at the time of opening and closing the lid 120. In other words, the lid body 100 according to this embodiment ensures a smooth opening and closing of the lid 120.

In the lid body 100 according to this embodiment, the internal wall 113 has an upper end bent inward to define a guide 113*a*, which guides the projection 121 to be fitted into the groove 115. The external wall 114, which is notched near each longitudinal center of the two widthwise ends (longitudinal edges) of the frame 110, can reduce the interference between the projection 121 and the internal wall 113 and between the projection 121 and the external wall 114 at the time of opening and closing the lid 120. In other worlds, the lid body 100 according to this embodiment can ensure a smooth opening and closing of the lid 120.

The lid body 100 according to this embodiment includes the tab 123 and the locking part 117. The tab 123 is disposed on the widthwise end (longitudinal edge), not connected to the hinge section 130, of the lid 120. The locking part 117 is disposed on the widthwise end (longitudinal edge), not connected to the hinge section 130, of the frame 110 to lock the tab 123.

The lid body 100 according to this embodiment is provided with the push tabs 116, 116 on the widthwise end (longitudinal edge), not connected to the hinge section 130, of the frame 110 such that they are each disposed on each side of the locking part 117. This configuration allows a user to open the lid 120 with the frame 110 pressed down by pressing down a push tab 116 with a finger. This facilitates the opening and closing of the lid 120. This configuration makes the center of the lid 120 less likely to be pressed, thus preventing the interference between the projection 121 and the external wall 114.

In the lid body 100 according to this embodiment, the area surrounded by the projection 121 peripherally disposed on the lid 120 has higher rigidity in the widthwise direction of the lid 120 than the outside of the area surrounded by the projection 121 of the lid 120 or the mating member 112 of the lid 120. This configuration can prevent deformation of the lid 120 and positional deviation between the projection 121 and the groove 115.

The embodiment of the present invention has been described, but the present invention is not limited to this embodiment, and various modifications may be made without departing from the scope of the invention.

In the above embodiment, the frame 110 has the mating member 112 peripherally disposed thereon and the lid 120 has the projection 121 peripherally disposed thereon. Alternatively, the frame 110 has the projection 121 peripherally disposed thereon and the lid 120 has the mating member 112 peripherally disposed thereon. The projection 121 is disposed around the frame opening 111 on the frame 110. In this case, the ribs 122, 122 are disposed inside the a surrounded by the mating member 112 peripherally disposed on the lid 120.

In the above embodiment, the protrusion 117*a* is disposed on the locking part 117. Alternatively, the locking part 117 may have any configuration that can lock the tab 123 to close the lid 120.

In the above embodiment, the tab 123 is provided with the locking member 123*a*. Alternatively, the tab 123 may have any configuration that can be held between fingers and locked by the locking part 117.

In the above embodiment, the push tabs 116, 116 are each disposed on each side of the widthwise end (longitudinal edge), not connected with the hinge section, of the frame 110, each side being closer to one of the longitudinal ends. Alternatively, the push tab 116 may be disposed on only one side closer to one of the longitudinal ends.

In the above embodiment, the rear surface of the frame 110 is glued to the bag body 10. This is not limitative. Alternatively, for example, the lid body 100 may be fixed detachably, removed and attached to any other bag 30 after the wet wipes S in the bag 30 are used up.

In the above embodiment, the frame 110, the lid 120, and the hinge section 130 are integrally formed of resin. Alternatively, the frame 110, the lid 120, and the hinge section 130 may be formed separately.

In the above embodiment, the internal wall 113 has an upper end bent inward to define a guide 113*a*. The external wall 114 is notched near each longitudinal center of the two widthwise ends (longitudinal edges) of the frame 110. Alternatively, the guide 113*a* of the internal wall 113 or the notch on the external wall 114 may be omitted.

The details of the wet wipes package and the lid body may be changed without departing from the scope of the invention.

INDUSTRIAL APPLICABILITY

The present invention may be used for a lid body for a wet wipes package and the wet wipes package provided with the lid.

DESCRIPTION OF REFERENCE NUMERALS

1 wet wipes package
30 bag
10 bag body
11 body opening
20 flap
100 lid body for wet wipes package
110 frame
111 frame opening
112 mating member
113 internal wall
**113*a*** guide
114 external wall
115 groove
116 push tab
117 locking part
**117*a*** protrusion

120 lid
121 projection
122 rib (reinforcing member)
123 tab
123*a* locking member
130 hinge section
S wet wipes

The invention claimed is:

1. A lid body for a wet wipes package to be attached to a bag body of the wet wipes package, the lid body comprising:

a frame having a frame opening which is arranged to surround a bag opening formed on a top surface of the bag body in a state in which the lid body is attached to the bag body, wherein the frame has a shape defined by a first edge, a second edge opposite the first edge, a third edge adjacent to the first edge and the second edge, and a fourth edge opposite the third edge; and a lid pivotally coupled to the first edge of the frame via a hinge section and which is arranged to block the frame opening from a top side of the frame when the lid is in a closed state, wherein the top side of the frame faces a bottom side of the lid when the lid is in the closed state;

wherein:

one of the frame and the lid has a projection peripherally disposed thereon and protruding from the bottom side of the lid or the top side of the frame, the other of the frame and the lid has a mating member peripherally disposed thereon and protruding from the bottom side of the lid or the top side of the frame, the mating member being engageable with the projection, the mating member includes an internal wall, an external wall, and a groove defined therebetween, the internal wall has an upper end bent inward to define a guide which guides the projection to be fitted into the groove, the external wall has a first notch at a position which substantially corresponds to a longitudinal center of the first edge, and a second notch at a position which substantially corresponds to a longitudinal center of the second edge, a distance between the projection and an outer edge of the hinge section at a position with a shortest distance between the frame opening and the hinge section is at least five times an overlapping height between the projection and the mating member when the lid is in the closed state, the overlapping height is a height of an overlapped portion of the projection and the mating member, the overlapping height is at least 1.5 mm, the overlapped portion is defined such that, at the overlapped portion, the projection is in close contact with the mating member at least at its tip and is in contact with the mating member with a clearance of 0.2 mm or less at all portions other than the tip, and the position with the shortest distance between the frame opening and the hinge section coincides with the position of the first notch in the external wall.

2. The lid body for the wet wipes package according to claim 1, further comprising:

a tab disposed on a second edge of the lid which is opposite a first edge of the lid where the hinge section is connected;

a locking part disposed on the second edge of the frame opposite the first edge of the frame where the hinge section is connected, the locking part being engageable with the tab; and push tabs disposed on the second edge of the frame, the push tabs each being disposed on respective sides of the locking part along the second edge of the frame.

3. The lid body for the wet wipes package according to claim 1, wherein a first area surrounded by the projection or the mating member peripherally disposed on the lid has higher rigidity than a second area outside of the first area surrounded by the projection or the mating member of the lid.

4. A wet wipes package comprising:

a bag that includes a bag body having a body opening on a top surface thereof and a flap covering the body opening in a freely openable and closable manner; and the lid body for the wet wipes package according to claim 1, wherein the lid body is attached to the top surface of the bag body.

5. The lid body for the wet wipes package according to claim 1, wherein the distance between the projection and the outer edge of the hinge section at the position with the shortest distance between the frame opening and the hinge section is at least ten times the overlapping height between the projection and the mating member when the lid is in the closed state.

* * * * *